US008863361B2

(12) United States Patent
Neukoetter

(10) Patent No.: US 8,863,361 B2
(45) Date of Patent: Oct. 21, 2014

(54) DOOR HINGE FOR RECESSED INSTALLATION BETWEEN DOOR EDGE AND JAMB

(71) Applicant: Hubert Neukoetter, Beelen (DE)

(72) Inventor: Hubert Neukoetter, Beelen (DE)

(73) Assignee: Simonswerk GmbH, Rheda-Wiedenbrueck (DE)

( * ) Notice: Subject to any disclaimer, the term of this patent is extended or adjusted under 35 U.S.C. 154(b) by 0 days.

(21) Appl. No.: 13/774,268

(22) Filed: Feb. 22, 2013

(65) Prior Publication Data

US 2013/0219662 A1 Aug. 29, 2013

(30) Foreign Application Priority Data

Feb. 29, 2012 (DE) ..... 10 2012 101 644

(51) Int. Cl.
*E05D 7/04* (2006.01)
*E05D 3/18* (2006.01)

(52) U.S. Cl.
CPC ..... *E05D 3/186* (2013.01); *E05D 2007/0469* (2013.01); *E05Y 2900/132* (2013.01); *E05D 7/0423* (2013.01); *E05D 2007/0484* (2013.01)
USPC ..... 16/368; 16/366

(58) Field of Classification Search
CPC ..... E05D 3/186; E05D 3/06; E05D 3/12; E05D 3/16; E05D 11/06
USPC ..... 16/368, 366, 369, 371, 389, 355, 356, 16/357, 361, 362, 236, 237, 238, 245, 382
See application file for complete search history.

(56) References Cited

U.S. PATENT DOCUMENTS

| | | | | |
|---|---|---|---|---|
| 3,209,390 | A * | 10/1965 | Bassan | 16/383 |
| 3,596,307 | A * | 8/1971 | Kolmetsky | 16/237 |
| 3,863,292 | A * | 2/1975 | Grunert et al. | 16/236 |
| 6,487,755 | B1 | 12/2002 | Caldari | |
| 6,829,808 | B2 * | 12/2004 | Neukotter | 16/366 |
| 7,861,378 | B2 * | 1/2011 | Neukotter | 16/366 |
| 8,196,265 | B2 * | 6/2012 | Neukoetter et al. | 16/389 |
| 8,434,197 | B2 * | 5/2013 | Oshima | 16/357 |
| 8,621,717 | B2 * | 1/2014 | Liermann | 16/364 |
| 8,650,713 | B2 * | 2/2014 | Migliorini | 16/302 |
| 2003/0088943 | A1 * | 5/2003 | Neukotter | 16/366 |

(Continued)

FOREIGN PATENT DOCUMENTS

| | | | |
|---|---|---|---|
| DE | 102007041816 | B4 * | 8/2009 |
| EP | 1063376 | A2 * | 12/2000 |

(Continued)

*Primary Examiner* — Victor Batson
*Assistant Examiner* — Jason W San
(74) *Attorney, Agent, or Firm* — Andrew Wilford

(57) ABSTRACT

A door hinge for recessed installation between an edge of a door panel and a door jamb has first and second leaf assemblies that each form a cavity and are recessed in the door-panel edge and in the door jamb and a pair of U-section links pivoted centrally together about a center axis and each having a first end and a second end engaged in the cavities of the respective first and second leaf assemblies. The first end of one of the links and the second end of the other link are pivoted about respective vertical axes fixed in the respective leaf assemblies and the second end of the one link and the first end of the other link are pivotal about another respective vertical axis and horizontally shiftable in a respective guide of the respective leaf assemblies.

10 Claims, 3 Drawing Sheets

(56) References Cited

U.S. PATENT DOCUMENTS

| | | | | |
|---|---|---|---|---|
| 2007/0294860 | A1* | 12/2007 | Hoffman | 16/368 |
| 2010/0115729 | A1* | 5/2010 | Neukoetter | 16/235 |
| 2010/0122431 | A1* | 5/2010 | Neukoetter et al. | 16/238 |
| 2012/0266412 | A1* | 10/2012 | Liermann | 16/387 |
| 2012/0291222 | A1* | 11/2012 | Liermann | 16/237 |
| 2012/0291225 | A1* | 11/2012 | Liermann | 16/364 |

FOREIGN PATENT DOCUMENTS

| | | | |
|---|---|---|---|
| EP | 1574649 | A3 * | 9/2009 |
| EP | 2186979 | A2 * | 5/2010 |
| EP | 2525031 | A1 * | 11/2012 |
| WO | WO 2011013335 | A1 * | 2/2011 |

* cited by examiner

Fig.2
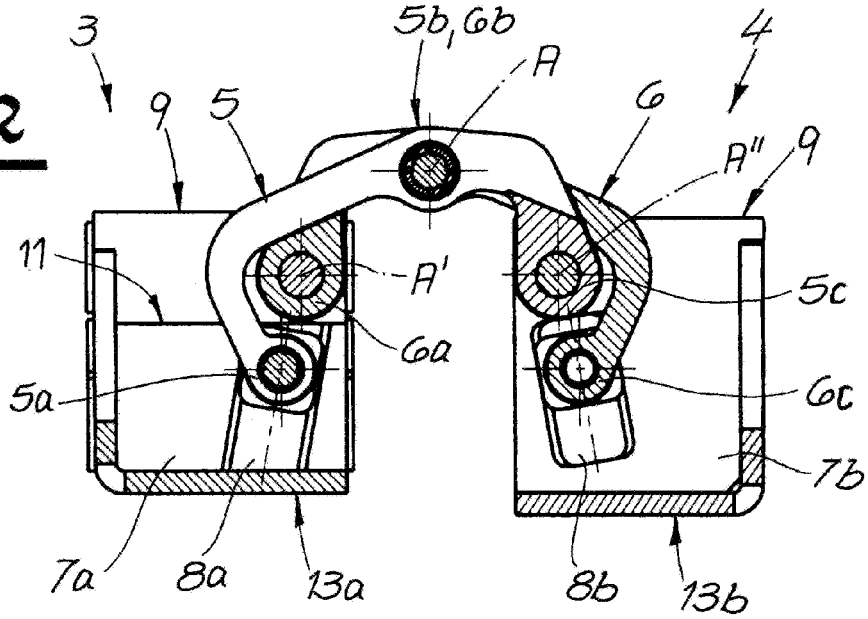
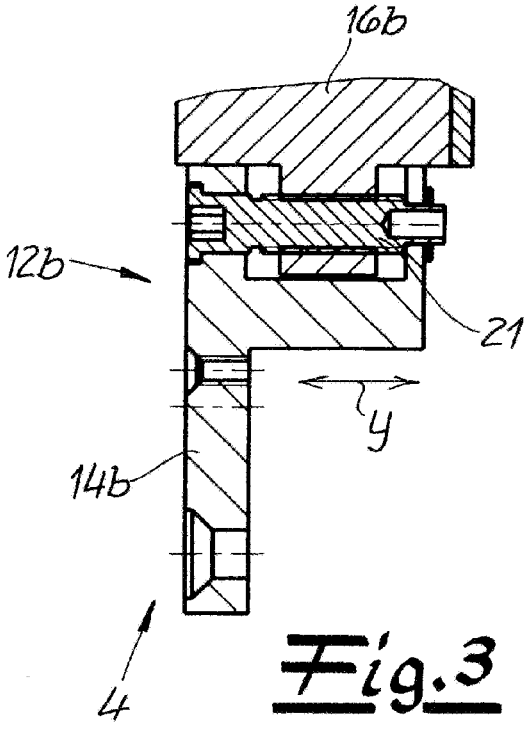
Fig.3
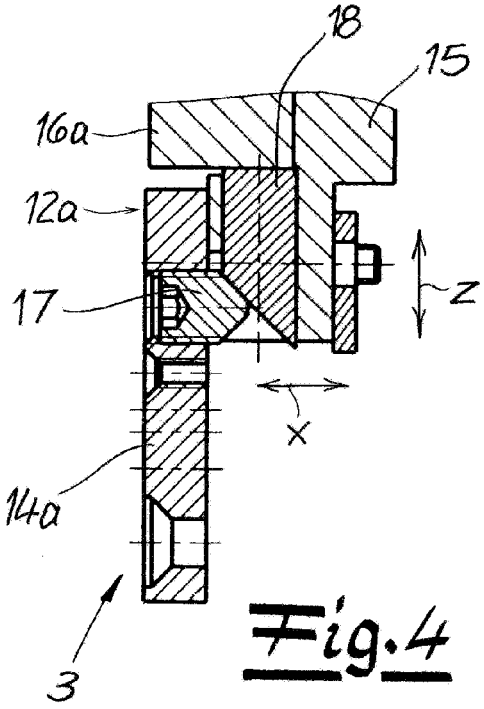
Fig.4

DOOR HINGE FOR RECESSED INSTALLATION BETWEEN DOOR EDGE AND JAMB

FIELD OF THE INVENTION

The present invention relates to a hinge. More particularly this invention concerns a hinge that is intended to be recessed in a door edge or jamb.

BACKGROUND OF THE INVENTION

A known door hinge for recessed installation between an edge of a door panel and a door jamb has first and second leaf assemblies that each form a cavity and are recessed in the door-panel edge and in the door jamb. A pair of U-section links pivoted centrally together about a center axis each have a first end and a second end engaged in the cavities of the respective first and second leaf assemblies. The first end of one of the links and the second end of the other link are pivoted about respective vertical axes fixed in the respective leaf assemblies and the second end of the one link and the first end of the other link are pivotal about another respective vertical axis and horizontally shiftable in a respective guide of the respective leaf assemblies. Thus when the assemblies are fitted to respective mortises in the jamb and door edge, when the door is closed the hinge is not visible.

As described in U.S. Pat. No. 6,829,808, one of the links is forked and partly U-shaped and the other of the links projects between the legs of the U. Thus the first end of the other link is substantially vertically shorter than the first end of the one link. The problem with this construction is that when used with a very heavy door, the links can deform, as they are not highly rigid and are not supported except at the pivot in the respective leaf assembly, Another door hinge with the above-described features is known from U.S. Pat. No. 7,861,378 where the hinge links are designed as constructionally identical U-shaped mounting elements with a connecting bight and vertically aligned legs. In order to be able to connect the physically identical hinge links to each other, one of the hinge links is rotated by 180° so that starting from the connecting bight, the vertically aligned legs of the rotated hinge link do not extend upward but downward. The two hinge links can then be joined together in the manner like a plug connector. The seat cavities of the leaf assemblies are completely bridged by the legs extending in the vertical direction. However, due to the U-shape, a certain elasticity remains between the vertically aligned legs and the connecting bight arranged therebetween, even in the case of a very heavy weight load.

A further door hinge of this type is known from U.S. Pat. No. 6,487,755. Here one half of each hinge link extends vertically along the door hinge, and to adjust the height of the door panel, the spacing between the hinge links can be changed. For this purpose, the pivot pin between the hinge links is formed as an adjusting spindle. The dimensional stability of the known arrangement needs improvement. This door hinge is suitable for installation in light door panels, for example in the furniture sector.

OBJECTS OF THE INVENTION

It is therefore an object of the present invention to provide an improved door hinge for recessed installation in a door edge and jamb.

Another object is the provision of such an improved door hinge for recessed installation in a door edge and jamb that overcomes the above-given disadvantages, in particular that, due to its construction, is particularly suitable for heavy door panels and nevertheless can be produced and assembled in a simple manner.

SUMMARY OF THE INVENTION

A door hinge for recessed installation between an edge of a door panel and a door jamb has according to the invention first and second leaf assemblies that each form a cavity and are recessed in the door-panel edge and in the door jamb and a pair of U-section links pivoted centrally together about a center axis and each having a first end and a second end engaged in the cavities of the respective first and second leaf assemblies. The first end of one of the links and the second end of the other link are pivoted about respective vertical axes fixed in the respective leaf assemblies and the second end of the one link and the first end of the other link are pivotal about another respective vertical axis and horizontally shiftable in a respective guide of the respective leaf assemblies. The first end of the other link is substantially shorter than the first end of the one link, and bearing formations in the cavity of the first link vertically closely flank and horizontally guide the first end of the other link.

Thus the seat cavity of the first leaf assembly has a stepped shape adapted to the different lengths of the hinge links and comprises one step above and one step below the first hinge link. Advantageously, the total height of the two steps in the vertical direction corresponds substantially to the length difference between the first hinge link and the second hinge link in the seat cavity of the first leaf assembly.

According to the prior art, the hinge links in the seat cavities usually extend over the same length. The length is to be determined here within the seat cavities at the surfaces that are in each case farthest apart from each other in the vertical direction so that also in the case of a forked hinge link, the same length is at both ends, independent of the recess between the fork arms. In contrast, according to the present invention, the first hinge link within the seat cavity of the first leaf assembly is shorter in the vertical direction than the second hinge link. However, in order to avoid corresponding unsupported areas, the cavity has an adapted stepped shape. Accordingly, the cavity is formed in such a manner that it can be directly adjacent to the vertically opposing end faces of the second hinge link and, via the steps, can also be directly adjacent to the vertically opposing end faces of the first hinge link. Preferably, only a small gap allowing the movement is provided in the vertical direction, wherein this gap can also be used for the arrangement of sliding disks or the like.

According to a preferred configuration of the invention it is provided that extending from an end allocated to the first leaf assembly, the first hinge link comprises a center portion and an opposing end, wherein the end allocated to the first leaf assembly and the center portion extend in the vertical direction over the same length, and wherein the opposing end extends in the vertical direction beyond the center portion. The result is a T-shape rotated by 90°.

In contrast, the second hinge link can have an opening that is closed around its circumference and through which the first hinge link extends. Thus, the opening is formed between two vertical end portions and two horizontal webs that are spaced apart from each other. Thus, in the broadest sense, the shape of the second hinge link can be designated as O-shaped or frame-shaped. Since the opening for the first hinge link is completely closed around its circumference, in contrast to a U-shape or a fork shape, there is no risk of deformation.

In the case of a T-shape (rotated by 90°) of the first hinge link and an O-shape of the second hinge link, the first hinge link is inserted with its end allocated to the leaf assembly through the opening. Connecting the first hinge link to the second hinge link is then carried out at the center portion. The first hinge link can be slid with its first end into the opening because this end is not widened with respect to the center portion. However, by means of the stepped shape of the allocated cavity, this end, which is shorter in the vertical direction, is reliably supported without the need of bridging a rather large gap with a pin or the like in a cantilever-type manner.

The described T- or O-shape of the hinge links refers to a front view of the hinge links along a horizontal direction. In contrast, in a top view or in a horizontal section, the hinge links have a shape that is substantially bent like a C, wherein the ends of the hinge links, which ends are bent in the top view, extend into the seat cavities of the leaf assemblies, and wherein the center portions including the vertical rotation axis that connects the two hinge links extend outside of the seat cavities when the door hinge is open.

Since in the case of the described shape of the hinge links only the end of the first hinge link has to be inserted through the opening of the second hinge link, the end of the first hinge link that is allocated to the second leaf assembly can extend over a greater length in the vertical direction. Thus, according to a preferred configuration of the invention, the first and the second hinge links extends in the cavity of the second leaf assembly in the vertical direction over the same length. A stepped shape on the second leaf assembly is therefore not necessary.

Due to the improved construction of the hinge links, the door hinge according to the invention can preferably also be used for heavy door leaves with a weight of up to 300 kg or more.

For the further configuration of the door hinge, different preferred possibilities arise within the context of the invention.

Thus, according a preferred refinement at least one of the leaf assemblies, preferably both leaf assemblies, has end parts that hold the hinge links and are connected by a steel profile. With such a modular structure, the leaf assembly or parts can be produced in a comparatively cost-effective manner. Nevertheless, the leaf assemblies can be produced with sufficient stability even in the case of a modular structure. The steel profile, for example, can be bent from sheet metal and can have be of L-section with two legs or a U-section. Particularly good stability is achieved if the sheet metal profile is screwed to the two end parts connected at the end side of the sheet metal profile.

The massive and normally cast end parts too can be composed of a plurality of parts. In particular, the end parts can each have one holding element that receives the hinge links and also a mounting element that can be fastened to the door jamb or the door panel, the holding element and the mounting element being connected by an adjusting mechanism. Parts that are moveable relative to each other in such a manner, make possible an adjustable door hinge. An adjustment can be carried out along slots, for example, by means of spindles or screw connections. Additionally or alternatively, eccentrics or wedges actuatable through a screw or the like are also possible as adjusting means. With such an adjusting mechanism, an adjustment between the holding element and the mounting element is possible in one direction. In order to obtain a door hinge that is overall adjustable in three directions, furthermore, it is also possible to provide a spacer between the holding element and the mounting element, the holding element then being adjustable with respect to the spacer in a first direction and the spacer being adjustable with respect to the mounting element in a second direction.

The shape of the steps provided according to the invention in the cavity of the first leaf assembly depends on the fastening and the guide of the hinge links on the first leaf assembly. Preferably, the steps divide the cavity of the first leaf assembly into a front area and a rear area with a low height. The allocation refers here to the side of the leaf assemblies that is visible in the assembled state, at which side also the hinge links extend out of the cavity. Here, the step can run parallel to the front side. However, in order to save material, the step can also be adapted to the shape of the receptacle for the first hinge link.

According to a preferred refinement of the invention, the end parts or, respectively, the mounting elements and the holding elements are implemented as milled parts. In contrast to the zinc die casting parts that are usually used, no demolding flanks are needed here so that as a result, undesirable play can be avoided or reduced.

The kinematics of the door hinge is determined through the arrangement of the hinge links and the guides for receiving the hinge links. According to a preferred configuration the first hinge link is guided in a rotatable and longitudinally movable manner in a guide in the cavity of the first leaf assembly, wherein coming from the front side of the cavity, the vertical rotation axis of the second hinge link is arranged in front of the guide. The arrangement in the cavity of the second leaf assembly can be carried out complementary, wherein, however, as described before, preferably no step is provided there. Accordingly, the first hinge link can be rotatable about a vertical rotation axis in the cavity of the second leaf assembly, a guide for receiving an allocated end of the second hinge link in a rotatable and longitudinally movable manner being provided behind the vertical rotation axis of the first hinge link.

BRIEF DESCRIPTION OF THE DRAWING

The above and other objects, features, and advantages will become more readily apparent from the following description, reference being made to the accompanying drawing in which:

FIGS. 2, 3, and 4 are sections taken respectively along lines II-II, and IV-IV of FIG. 1.

DETAILED DESCRIPTION OF THE INVENTION

Figure 1:
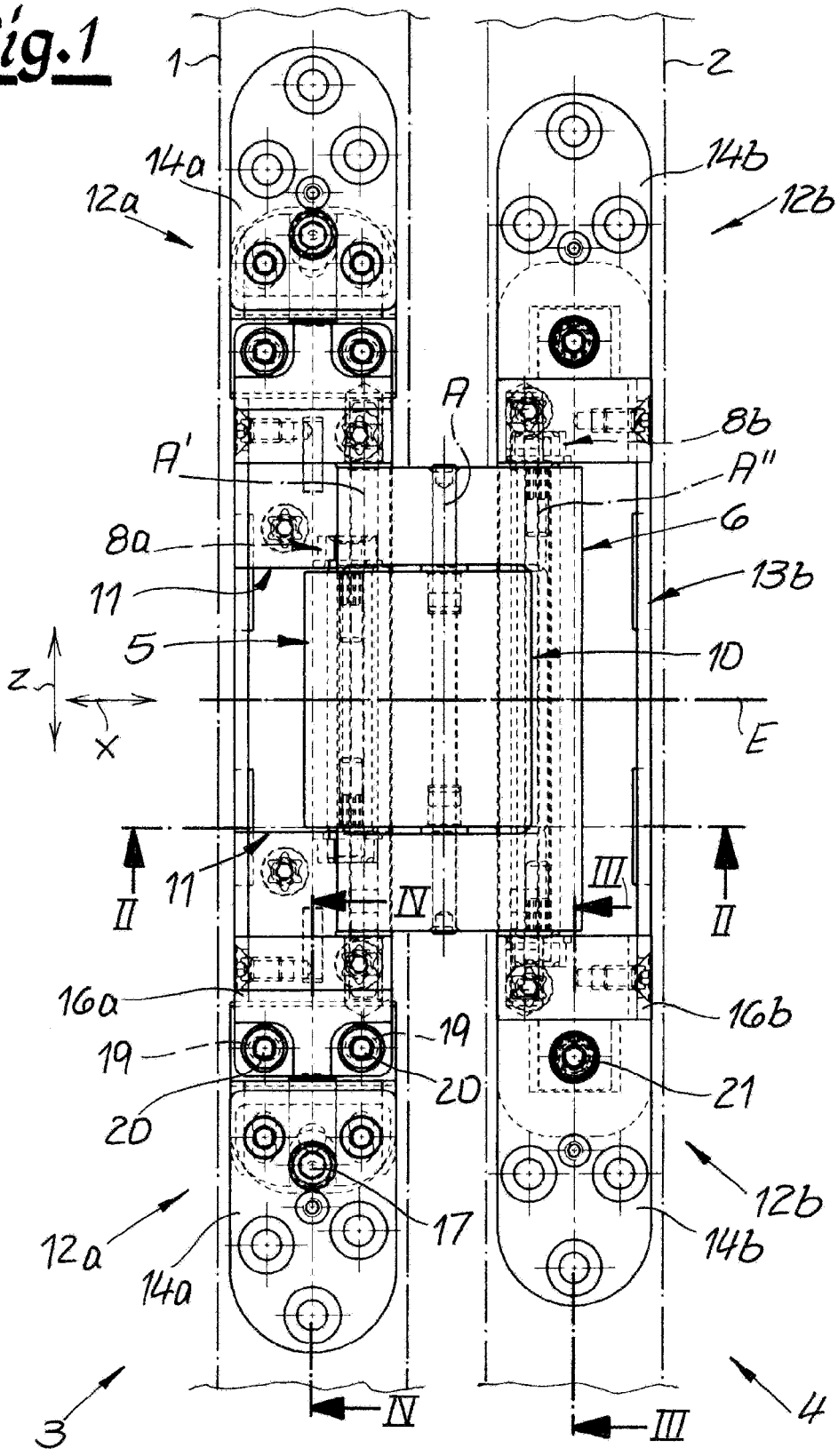
FIG. 1 is a large-scale view of the door hinge according to the invention in a fully open condition, that is with the plane of the door leaf parallel to but offset from the plane of the opening in which it fits.

As seen in FIGS. 1 and 2 a door hinge according to the invention is intended for recessed installation between a door jamb 1 and a door panel 2. The hinge is illustrated in the fully open condition, that is with the door panel 2 swung back 180° from its closed position fitting in the jamb 1. Here a first leaf assembly 3 is recessed in a mortise in the door jamb 1, and a second leaf assembly 4 is similarly recessed in a mortise in the edge of the door panel 2. At least two such hinges are used to mount the door panel 2 in the door jamb 1.

The leaf assemblies 3 and 4 are interconnected as is well known in the art by a first U-section hinge link 5 and a second U-section hinge link 6 that are pivoted together at a central axis A. Here the axis A is parallel to the vertical indicated at z, but this is not necessarily the case and other orientations are within the scope of the invention.

As seen by a comparison of FIGS. 1 and 2, the two leaf assemblies 3 and 4 are formed with respective seat cavities 7*a* and 7*b*. A first end 5*a* of the first hinge link 5 is slidable in a guide 8*a* in the cavity 7*a* of the first leaf assembly 3, and a first end 6*a* of the second hinge link 6 is pivotal about a fixed vertical rotation axis A' in the cavity 7*a* of the first leaf assembly 3. As seen from a front side 9 of the first leaf assembly 3 as shown in FIG. 5, the first end 6*a* of the second hinge link 6 with the vertical rotation axis A' is outward of the guide 8*a*.

Figure 5:
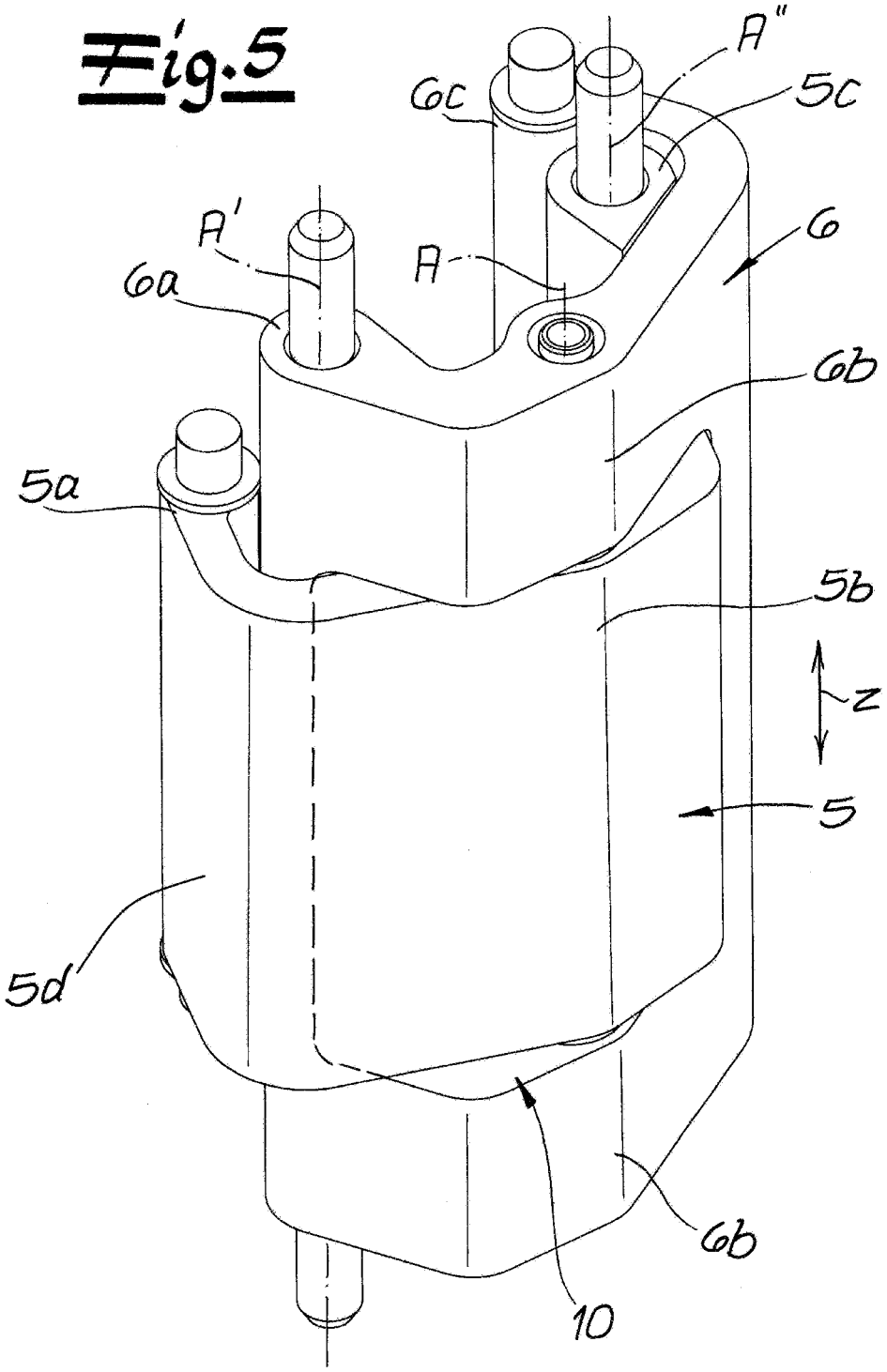
FIG. 5 is a large-scale perspective view of the link subassembly of the inventive hinge.

According to the invention, the first hinge link 5 whose first end 5*a* is in the cavity 7*a* of the first leaf assembly 3, is shorter in the vertical direction z than the second hinge link 6 at its first end 6*a* (FIG. 5). As shown by the perspective view of the two hinge links 5 and 6, the first hinge link 5, in a side view, has a sideways T-shape while the second hinge link 6 has an opening 10 that is closed and through which a central leg 5*d* of the T-shaped first link 5 extends.

A comparison of FIGS. 1 and 2 shows in this connection that the first hinge link 5 extends with its first end 5*a* through the opening 10 in the second hinge link 6. At a center portion 5*b* of the first hinge link 5 and at webs 6*b* of the second hinge link 6 that border the opening 10, the first hinge link 5 and the second hinge link 6 are connected to each other at the above-described vertical central pivot axis A.

FIGS. 1, 2, and 5 show that the first hinge link 5 and the second hinge link 6 each have a second end 5*c* and 6*c* that extends in the vertical direction z over the same length. While the second end 5*c* of the first hinge link 5 is rotatably connected around a fixed vertical rotation axis A" to the second leaf assembly 4, the second end 6*c* of the second hinge link 6 is slidable in a guide 8*b* of the second cavity 7*b*, like the other first end 5*a* in its guide 8*a*.

In order that the cavity 7*a* of the first leaf assembly 3, despite the shorter length of the first hinge link 5 at its first end 5*a*, can vertically support the first hinge link, the cavity 7*a* of the first leaf assembly 3 is formed with an inset horizontal flat face or step 11 both above and below the first end 5*a* of the first hinge link 5. The vertical spacing of the two steps 11 corresponds here to the vertical length of the end 5*a* of the link 5.

The door hinge is preferably configured to be symmetrical around a horizontal center plane E so that it can be used without limitation for left-hand and, after a 180° rotation, also for right-hand doors.

In the illustrated embodiment, the first leaf assembly 3 and the second leaf assembly 4 have respective end parts 12*a* and 12*b* holding the hinge links 5 and 6, and a respective steel profiles 13*a* and 13*b* connecting the respective end parts 12*a* and 12*b*. The two end parts 12*a* are identical as are the two end parts 12*b*.

FIG. 1 shows that the steel profiles 13*a* and 13*b* are screwed to the respective end parts 12*a* and 12*b* so as to form stable and rigid housings in turn forming the cavities 7*a* and 7*b*. Finally, the end parts 12*a* and 12*b* are each also composed of a plurality of parts.

Thus as shown in FIG. 4, the end parts 12*a* of the first leaf assembly 3 enable adjustment in the vertical direction z and an adjustment in a first horizontal direction x perpendicular to the plane of the door panel 1, while as shown in FIG. 3 the end parts 12*b* of the second leaf assembly 4 enable adjustment in a second horizontal direction y parallel to the plane of the door panel 1.

For such adjustment in the vertical direction z and the first horizontal direction x, the end parts 12*a* of the first leaf assembly 3 are each formed by a mounting element 14*a* that is fixed to the door jamb 1, a spacer 15, and a support element 16*a* that carries the hinge links 5 and 6 in the respective cavity 7*a*.

In order to enable adjustment in the vertical direction, the support element 16*a* can be shifted with respect to the mounting element 14*a* by a set screw 17 and a wedge 18, the screw 17 being driven inward (toward the right in FIG. 4) to shift the mounting element 16*a* upward and outward to allow it to move downward in the direction z. Furthermore, horizontal adjustment along the first direction x is achieved in that, after loosening screws 20, the support element 16*a* receiving the hinge links 5 and 6 can be laterally displaced along slots 19 with respect to the spacer 15 and can be fixed in the desired position by then tightening the screws 20 (FIG. 1).

At the end parts 12*b* of the second leaf assembly 4, adjustment is provided only along the second horizontal direction y parallel to the plane of the door opening by means of the adjusting spindles 21. For this purpose, the end parts 12*b* of the second leaf assembly 4 each have a mounting element 14*b* that can be fastened to the door panel 2, and a support element 16*b* that carries the hinge links 5 and 6. The adjusting spindles 21 can move the holding elements 16 with respect to the respective mounting elements 14*b* in the second horizontal direction y with respect to the edge of the door panel 2.

The adjustment along the second horizontal direction y serves for adjusting the door panel 2 parallel to its outer surfaces when the door panel 2 is closed so as to set the gap remaining on both sides between the door jamb 1 and the door panel 2.

The adjustment along the first horizontal direction x perpendicular to the plane of the door and/or the door opening is intended for adjusting the door panel 2 with regard to its closed position in the direction of the door thickness. In the case of standard doors provided with a door stop and a seal typically carried on the door stop, the exact position of the door panel 2 with respect to such a seal can be set in this manner, which is the reason why in practice the adjustment along the first horizontal direction x is also designated as compression adjustment.

Adjustment in the vertical direction z sets the height of the door panel 2 in the door jamb 1.

I claim:

1. A door hinge for recessed installation between an edge of a door panel and a door jamb, the hinge comprising:

first and second leaf assemblies that each form a cavity and that are recessed in the door-panel edge and in the door jamb;

respective horizontally displaceable first and second guides in the first and second leaf assemblies;

a pair of U-section links pivoted centrally together about a vertical center axis and each having a first end and a second end engaged in the cavities of the respective first and second leaf assemblies, the first end of one of the links and the second end of the other link being pivoted about respective fixed vertical axes fixed in the respective leaf assemblies, the second end of the one link and the first end of the other link being pivotal about respective movable vertical axes shiftable with the respective guides of the respective leaf assemblies, the first end of the other link being substantially vertically shorter than the first end of the one link; and steps in the first assembly forming axially confronting horizontal bearing formations vertically closely flanking and vertically bracing the first end of the other link.

2. The door hinge defined in claim 1, wherein the one link is generally T-shaped with a central leg forming the respective second end.

3. The door hinge defined in claim 2, wherein the other link has a central opening in which the central leg is pivoted and through which the central leg extends.

4. The door hinge defined in claim 1, wherein each of the formations is a horizontal flat step face closely juxtaposed with a respective planar end face of the first end of the other link.

5. The door hinge defined in claim 1, wherein the second ends of the first and second links are of the same vertical dimension.

6. The door hinge defined in claim 1, wherein at least one of the assemblies has a housing formed by a pair of cast-metal end parts and a sheet-metal intermediate part fixed to and between the end parts and forming therewith the respective cavity.

7. The door hinge defined in claim 6, wherein the housing further comprises a mounting part vertically supporting the respective link ends and means for shifting the mounting part in the respective cavity for adjustment of the hinge.

8. The door hinge defined in claim 6, wherein the one assembly is the first assembly and the mounting parts each have the two steps that vertically engage and guides the first end of the one bracket.

9. The door hinge defined in claim 7, wherein the means for shifting moves the mounting part vertically.

10. The door hinge defined in claim 7, wherein the means for shifting moves the mounting part horizontally.

* * * * *